US009417583B2

(12) United States Patent
Tao

(10) Patent No.: US 9,417,583 B2
(45) Date of Patent: Aug. 16, 2016

(54) IMAGE FORMING APPARATUS HAVING SETTING CHANGE SECTION TO SELECT MANUAL FEED TRAY AND IMAGE FORMING METHOD

(71) Applicant: KYOCERA Document Solutions Inc., Osaka (JP)

(72) Inventor: Kozo Tao, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/837,319

(22) Filed: Aug. 27, 2015

(65) Prior Publication Data

US 2016/0062291 A1 Mar. 3, 2016

(30) Foreign Application Priority Data

Aug. 29, 2014 (JP) ..... 2014-175361

(51) Int. Cl.
*G03G 15/00* (2006.01)

(52) U.S. Cl.
CPC ..... *G03G 15/5091* (2013.01); *G03G 15/502* (2013.01); *G03G 15/6514* (2013.01); *G03G 2215/00109* (2013.01)

(58) Field of Classification Search
CPC ..... G03G 15/5016; G03G 15/502; G03G 15/5091; G03G 15/5095; G03G 15/6508; G03G 15/6514; G03G 2215/00109; G03G 2215/00447; B65H 2801/03; B65H 2801/06; B65H 2801/15; B65H 3/44; B65H 3/446; B65H 2511/515; B65H 5/26
USPC ..... 399/23, 80, 81, 391, 392; 271/9.06, 271/9.03, 9.04, 9.05
See application file for complete search history.

(56) References Cited

U.S. PATENT DOCUMENTS

| | | | | |
|---|---|---|---|---|
| 6,125,242 | A * | 9/2000 | Yamada | B41J 3/60 399/23 |
| 2002/0051161 | A1* | 5/2002 | Kanazawa | G03G 15/50 358/1.12 |
| 2006/0282590 | A1* | 12/2006 | Yoshimura | G03G 15/6508 710/260 |
| 2007/0071477 | A1* | 3/2007 | Tanaka | G03G 15/6508 399/82 |
| 2008/0075491 | A1 | 3/2008 | Tao | |

FOREIGN PATENT DOCUMENTS

| | | | |
|---|---|---|---|
| JP | H10-091040 | A | 4/1998 |
| JP | 2004023387 | A * | 1/2004 |
| JP | 2008-76920 | A | 4/2008 |

* cited by examiner

*Primary Examiner* — Robert Beatty
(74) *Attorney, Agent, or Firm* — Studebaker & Brackett PC

(57) ABSTRACT

In absence of a paper feed source matching paper information specified in settings that are input by a user for a job to be executed, permission information associated with the user may not permit use of a manual feed tray as a substitute paper feed source. Upon completion of the job executed in response to selection of a forced execution key, a forced execution determination section determines whether or not an execution number exceeds a predetermined threshold. The execution number indicates how many times a job has been executed in response to selection of the forced execution key. When the execution number exceeds the threshold, a permission information updating section updates the permission information associated with the user so as to permit use of the manual feed tray as the substitute paper feed source.

10 Claims, 5 Drawing Sheets

406 407 408

| ID | Password | Permission information<br>Manual feed setting information |
|---|---|---|
| AAA | aaa | No |
| BBB | bbb | Yes |
| ... | ... | ... |

405

IMAGE FORMING APPARATUS HAVING SETTING CHANGE SECTION TO SELECT MANUAL FEED TRAY AND IMAGE FORMING METHOD

INCORPORATION BY REFERENCE

The present application claims priority under 35 U.S.C. §119 to Japanese Patent Application No. 2014-175361 filed on Aug. 29, 2014. The contents of this application are incorporated herein by reference in their entirety.

BACKGROUND

The present disclosure relates to image forming apparatuses and image forming methods.

In a conventional practice among business organizations and offices, image forming apparatuses (for example, printers, copiers, and multifunction peripherals) are shared among a plurality of users. For such image forming apparatuses, various techniques relevant to paper settings are available.

In one example, an image forming apparatus is provided with a paper feed source and information about the paper feed source. The paper feed source is loaded with specific type of paper. Permission information is appended to the information about the paper feed source. When a user designates the use of the paper feed source, the image forming apparatus permits printing from the paper feed source on condition that header information set by the user matches the permission information.

In an image forming apparatus of another example, when a print job is suspended upon occurrence of a paper-related error, an operation section of the image forming apparatus accepts selection of a paper feed source to be used as a substitute paper source for forcefully continuing the print job. The image forming apparatus stays standby without resuming the print operation even if paper is loaded or the paper size selection is changed. Upon final approval by the user, the image forming apparatus resumes the print operation on paper fed from the paper feed source selected for the forced printing.

SUMMARY

An image forming apparatus according to one aspect of the present disclosure includes a setting change determination section, a forced execution receiving section, a setting change section, a forced execution determination section, and a permission information updating section. The setting change determination section determines, in absence of a paper feed source matching paper information specified in settings that are input by a user for a job to be executed, whether or not permission information associated with the user permits use of a manual feed tray as a substitute paper feed source. When the permission information does not permit use of the manual feed tray as the substitute paper feed source, the forced execution receiving section informs the user about absence of a paper feed source matching the paper information specified in the settings and receives selection of a forced execution key by the user. The forced execution key is for causing forced execution of the job using the manual feed tray as the substitute paper feed source. The setting change section changes the settings for the job so as to use the manual feed tray as the substitute paper feed source in response to selection of the forced execution key. The forced execution determination section determines whether or not an execution number exceeds a predetermined threshold upon completion of the job. The execution number indicates how many times a job has been executed in response to selection of the forced execution key. When the execution number exceeds the threshold, the permission information updating section updates the permission information associated with the user so as to permit use of the manual feed tray as the substitute paper feed source.

An image forming method according to one aspect of the present disclosure includes: determining, in absence of a paper feed source matching paper information specified in settings that are input by a user for a job to be executed, whether or not permission information associated with the user permits use of a manual feed tray as a substitute paper feed source; informing the user, when the permission information does not permit use of the manual feed tray as the substitute paper feed source, about absence of a paper feed source matching the paper information specified in the settings and receiving selection of a forced execution key by the user, the forced execution key being for causing forced execution of the job using the manual feed tray as the substitute paper feed source; changing the settings for the job so as to use the manual feed tray as the substitute paper feed source in response to selection of the forced execution key; determining whether or not an execution number exceeds a predetermined threshold upon completion of the job, the execution number indicating how many times a job has been executed in response to selection of the forced execution key; and updating, when the execution number exceeds the threshold, the permission information associated with the user so as to permit use of the manual feed tray as the substitute paper feed source.

DETAILED DESCRIPTION

With reference to the accompanying drawings, the following describes an image forming apparatus and an image forming method according to the present disclosure. Note that the embodiment described below is one implementation example of the present disclosure and should not be construed as limiting the technical scope of the present disclosure. In addition, the letter S preceding each numeral that appears in the flowcharts stands for "step".

The following describes an image forming apparatus as an exemplary embodiment according to the present disclosure. The image forming apparatus according to the present disclosure is for example a multifunction peripheral (MFP) combining a plurality of functions (of, for example, a facsimile machine, a copier, a scanner, and a printer).

Figure 1:
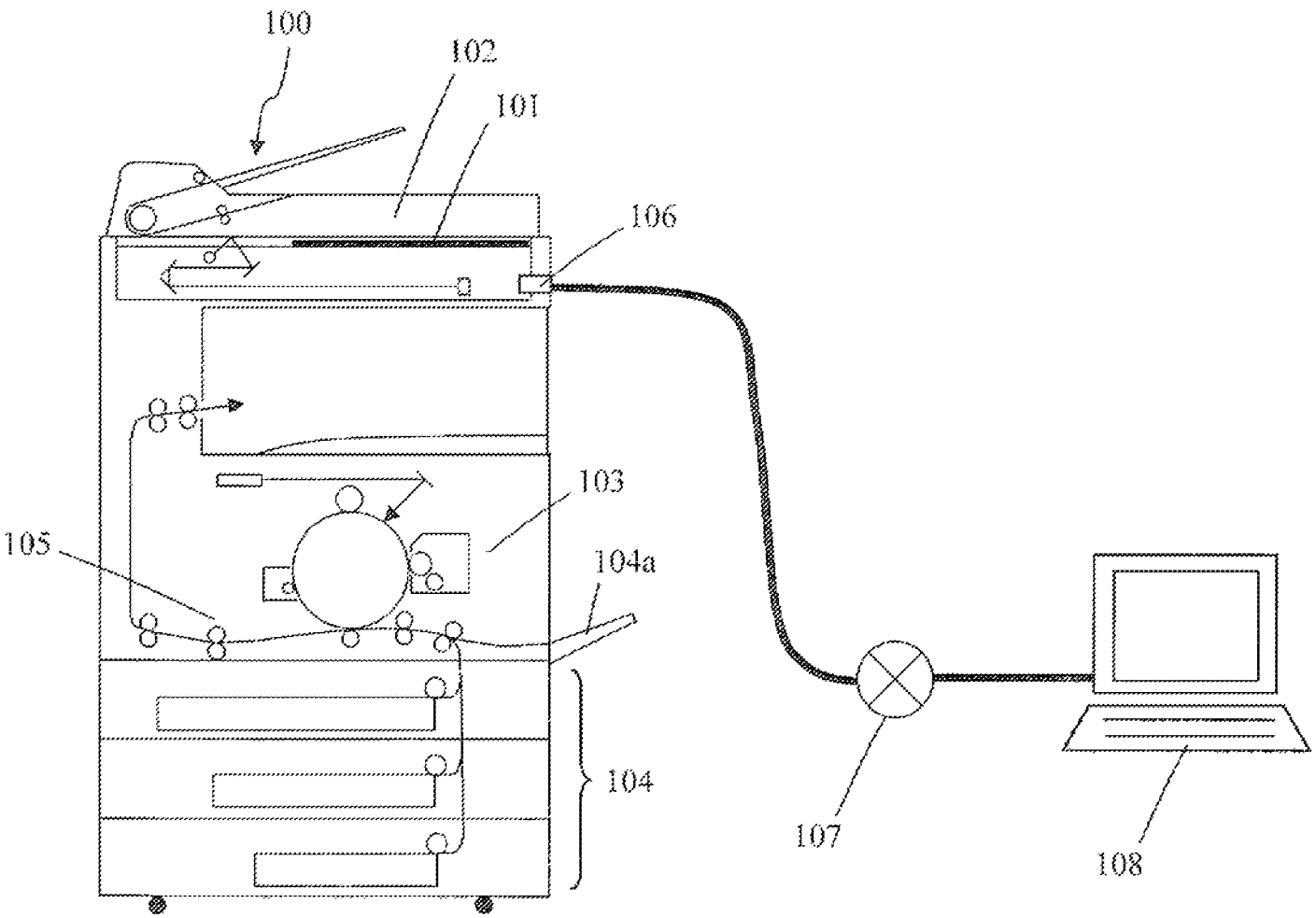
FIG. 1 is a schematic diagram showing the internal structure of an overall multifunction peripheral according to the present disclosure.

As shown in FIG. 1, the MFP 100 includes an operation section 101, an image reading section 102, an image forming section 103, a conveyance section 104, a fixing section 105, and a communication section 106. The operation section 101 includes a touch panel. The MFP 100 receives settings for execution of a print job from a user on the operation section 101. Upon receipt of the settings, the MFP 100 drives the relevant sections (namely, the image reading section 102, the image forming section 103, the conveyance section 104, and the fixing section 105) to execute the print job.

The conveyance section 104 includes a plurality of paper feed sources and a manual feed tray 104*a*. The manual feed tray 104*a* is provided on a side surface of the MFP 100. On the manual feed tray 104*a*, any size of paper can be loaded as desired by a user. The conveyance section 104 conveys paper from the manual feed tray 104*a* when the settings received on the operation section 101 includes a feed source setting designating the manual feed tray 104*a* as the paper feed source.

The communication section 106 is communicatively connected to a server 108 (terminal device) over a network 107. The server 108 stores data for user authentication.

The MFP 100 further includes a control circuit. Although not illustrated, the control circuit includes a central processing unit (CPU), a read only memory (ROM), a random access memory (RAM), a hard disk drive (HDD), a plurality of drivers, and an internal bus. The drivers control the driving sections of the respective sections described above, and the internal bus connects the ROM, RAM, HDD, and the drivers.

The CPU of the MFP 100 uses the RAM as a work area and executes programs stored on the ROM, HDD, and other storage locations. The CPU exchanges signals (for example, data, instructions, or directives) with the drivers based on execution results of the programs and controls operation of the driving sections relevant to execution of a print job. The later described sections (shown in FIG. 2) other than driving sections are implemented by the CPU executing an appropriate program. Programs and data for implementing the respective sections described below are stored on the ROM, RAM, HDD, and other storage location.

Figure 2:
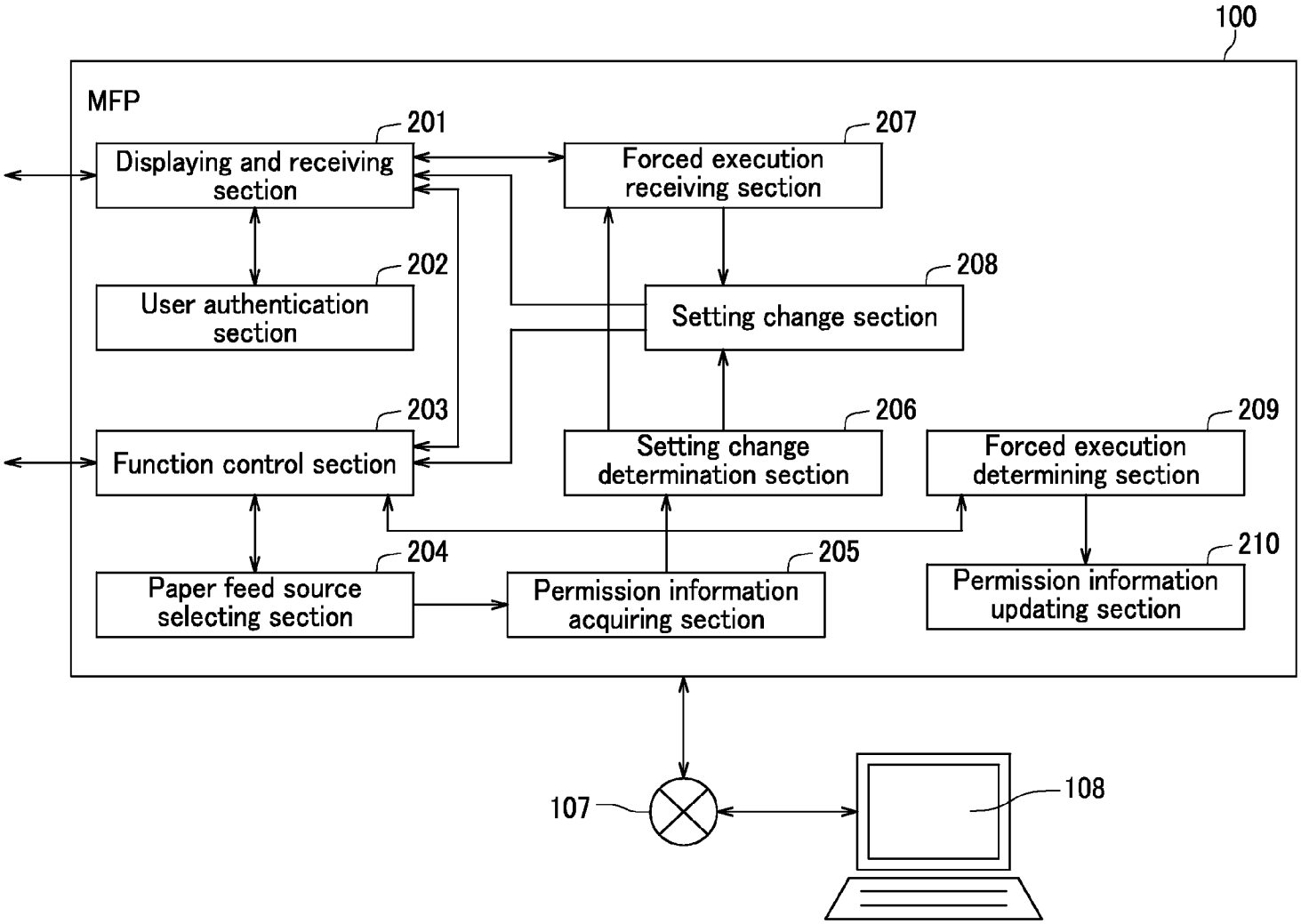
FIG. 2 is a functional block diagram of the multifunction peripheral according to the present disclosure.
Figure 3:
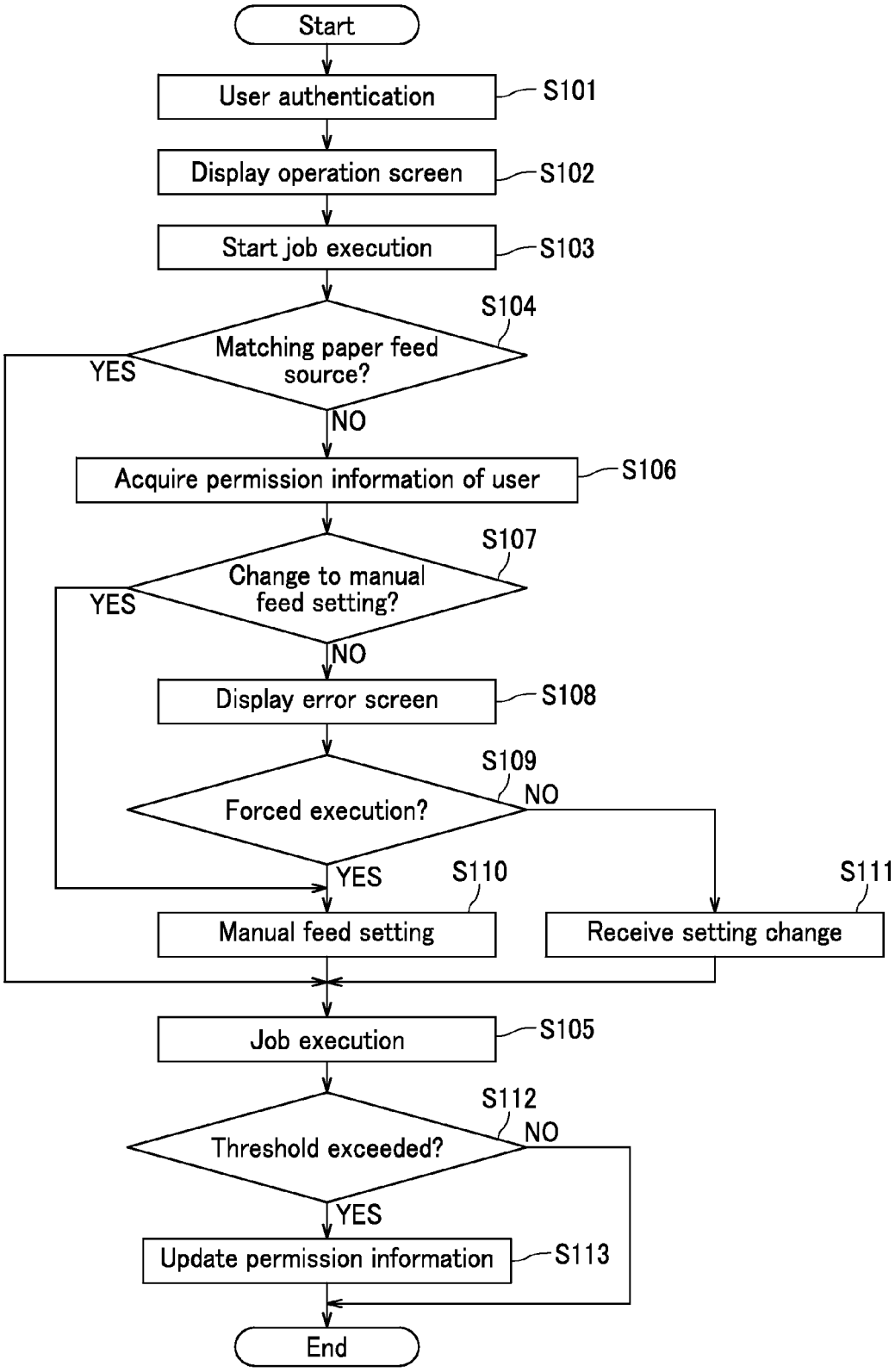
FIG. 3 is a flowchart of an execution procedure according to the present disclosure.

Next, with reference to FIGS. 2 and 3, the following describes the structure and the execution procedure according to the embodiment of the present disclosure.

The MFP 100 further includes a displaying and receiving section 201, a user authentication section 202, a function control section 203, a paper feed source selecting section 204, a permission information acquiring section 205, a setting change determination section 206, a forced execution receiving section 207, a setting change section 208, a forced execution determination section 209, and a permission information updating section 210.

First, when a user activates the MFP 100, the displaying and receiving section 201 displays an authentication screen on the touch panel of the operation section 101. The displaying and receiving section 201 then receives a user ID and a password input by the user.

Figures 4A, 4B:
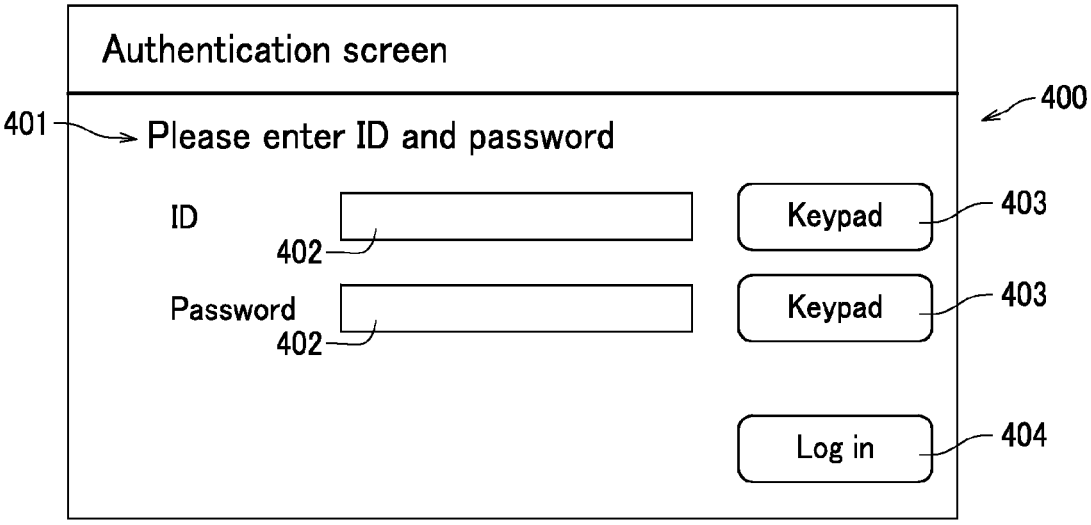
FIG. 4A shows an example of an authentication screen according to the present disclosure.
FIG. 4B shows an example of a user authentication table according to the present disclosure.

As shown in FIG. 4A, the authentication screen denoted by a reference sign 400 displays a message 401, entry fields 402, keypads 403, and a log-in key 404. The message 401 prompts the user to input a user ID and a password. The ID and the password are input into the entry fields 402.

On the authentication screen 400, the user inputs the ID "AAA" and the password "aaa" into the respective entry fields 402 using the keypads 403 and the like and then selects the log-in key 404. Through the above operation, the user logs in to the MFP 100 on the authentication screen 400. The displaying and receiving section 201 notifies the user authentication section 202 about the log-in of the user. In response to the notification from the displaying and receiving section 201, the user authentication section 202 performs authentication of the user based on the ID and the password of the user (FIG. 3: S101).

No particular limitations are placed on the method used for user authentication by the user authentication section 202. For example, the MFP 100 may store a user authentication table in a predetermined memory in advance. In such a case, the user authentication section 202 refers to the user authentication table. As shown in FIG. 4B, the user authentication table denoted by a reference sign 405 includes, for each user, a user ID 406, a password 407, a piece of permission information 408 in association with one another. More specifically, each password 407 is associated with a corresponding ID 406, and each piece of permission information 408 is associated with the corresponding ID 406. The user authentication section 202 determines whether a combination of the user ID and the password as input is found in the combinations of an ID 406 and a password 407 included in the authentication table 405. Hereinafter, this determination may be referred to as the first determination. Through this determination, the user authentication is performed.

Alternatively, the user authentication table 405 may be stored on the server 108 in advance. In such a case, the user authentication section 202 accesses the server 108 to make the first determination with reference to the user authentication table 405. The server 108 is communicatively connected to the MFP 100 via the network 107.

When no matching combination is found through the first determination performed in S101, the user authentication section 202 again prompts the user to input a correct ID and a correct password, using the displaying and receiving section 201. In contrast, when a matching combination is found through the first determination, the user authentication section 202 permits the user to use the MFP 100. The user authentication section 202 therefore causes the relevant sections of the MFP 100 to activate and causes the displaying and receiving section 201 to display an operation screen (FIG. 3: S102). The operation screen receives input of settings relevant to a predetermined function.

After granted a permission to use the MFP 100, the user inputs settings on the operation screen that is displayed by the displaying and receiving section 201. The settings include paper information specifying for example the paper size "A5" and the paper type "premium paper". The user then places a document on a placement table of the image reading section 102 and selects a start key. In response to input of the settings, the displaying and receiving section 201 notifies the function control section 203 about the settings. Upon receipt of the notification from the displaying and receiving section 201, the function control section 203 starts executing the job according to the settings received by the displaying and receiving section 201 (hereinafter, simply the "settings") (FIG. 3: S103).

More specifically, for example, the function control section 203 causes the operation of the image reading section 102 to acquire image data of the document. In addition, the function control section 203 issues to the paper feed source selecting section 204 an instruction to select a paper feed source that feeds paper. In response to the instruction from the function control section 203, the paper feed source selecting section 204 selects a paper feed source to be used in the job. More specifically, the paper feed source selecting section 204 searches the plurality of paper feed sources (paper feed cassettes) for a paper feed source matching the paper size and the paper type specified in the settings (FIG. 3: S104).

No particular limitations are placed on the method used by the user authentication section 202 to search for a paper feed source. For example, the MFP 100 may store, in a predetermined memory in advance, information indicating each paper feed source in association with the size and the type of paper loaded in the paper feed source. In such a case, the paper feed source selecting section 204 checks the size and the type of paper specified in the settings against the sizes and the types of paper stored in the predetermined memory to find a paper feed source matching the size and the type of the paper specified in the settings.

Alternatively to the predetermined memory, the MFP 100 may be provided with detection sensors for the respective paper feed sources, and each detection sensor detects the size and the type of paper loaded in the corresponding paper feed source. In such a case, the paper feed source selecting section 204 searches for a paper feed source that matches the size and the type of paper specified in the settings based on the detection results by the respective sensors.

When the search performed in S104 finds a paper feed source that matches the size and the type of paper specified in the settings (FIG. 3: S104, YES), the paper feed source selecting section 204 selects the matching paper feed source and notifies the function control section 203 about the selection. In response to the notification from the paper feed source selecting section 204, the function control section 203 causes the conveyance section 104 to convey a sheet of paper from the selected paper feed source. In addition, the function control section 203 controls the image forming section 103 in a timed relation with the conveyance of paper to cause a toner image conforming to image data to be formed on the sheet of paper. The function control section 203 then causes the operation of the fixing section 105 to fix the toner image. As a result, the job is executed according to the settings completes (FIG. 3: S105).

In contrast, when the search performed in S104 finds no paper feed source that matches the size and the type of paper specified in the settings (FIG. 3: S104, NO), the paper feed source selecting section 204 notifies the permission information acquiring section 205 about the search result. In response to the notification from the paper feed source selecting section 204, the permission information acquiring section 205 acquires the permission information associated with the user having input the settings (FIG. 3: S106) for the purpose of changing the settings as to the paper feed source.

No particular limitations are placed on the method used by the permission information acquiring section 205 for acquiring the permission information associated with the user. For example, the MFP 100 may store the user authentication table 405 in a predetermined memory. In such a case, the permission information acquiring section 205 acquires the ID of the user that is currently permitted to use the MFP 100 from the user authentication table 405. The permission information acquiring section 205 then acquires a piece of permission information 408 associated with the acquired user ID from the user authentication table 405 (the piece permission information 408 includes manual feed setting information indicating "NO").

Alternatively, the authentication table 405 may be stored on the server 108. In such a case, the permission information acquiring section 205 accesses the server 108 to acquire the permission information 408 associated with the ID of the user currently permitted to use the MFP 100 from the user authentication table 405.

Upon completing acquisition of the permission information associated with the user, the permission information acquiring section 205 notifies the setting change determination section 206 about the acquisition. In response to the notification from the permission information acquiring section 205, the setting change determination section 206 determines whether or not the acquired permission information is set to permit use of the manual feed tray 104*a* as a substitute paper feed source (FIG. 3: S107). Hereinafter, this determination may be referred to as the second determination.

No particular limitations are placed on the method used by the setting change determination section 206 for determining whether or not use of the manual feed tray 104*a* as the substitute paper feed source is permitted. For example, each piece of permission information includes manual feed setting information indicating either "YES" or "NO". The manual feed setting information indicating "NO" represents the setting that does not permit use of the manual feed tray 104*a* as the substitute paper feed source, and "YES" represents the setting that permits use of the manual feed tray 104*a* as the substitute paper feed source. The setting change determination section 206 determines whether or not the permission information indicates "YES" or "NO".

When the second determination in S107 results in that the permission information indicates "NO", that is, when the acquired permission information does not permit use of the manual feed tray 104*a* as the substitute paper feed source (FIG.: S107, NO), the setting change determination section 206 notifies the forced execution receiving section 207 about the determination result. In response to the notification from the setting change determination section 206, the forced execution receiving section 207 displays an error screen on the touch panel using the displaying and receiving section 201 (FIG. 3: S108). The error screen informs the user that no paper feed source matches the size and the type of paper specified in the settings (no paper that matches the currently set size and the type is available).

Figure 5A:
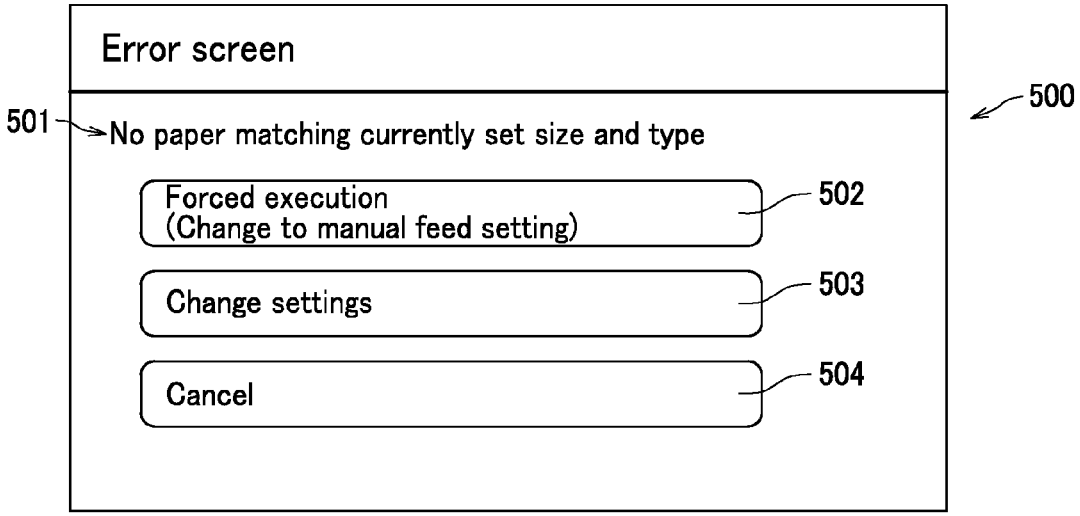
FIG. 5A shows an example of an error screen according to the present disclosure.
Figure 5B:
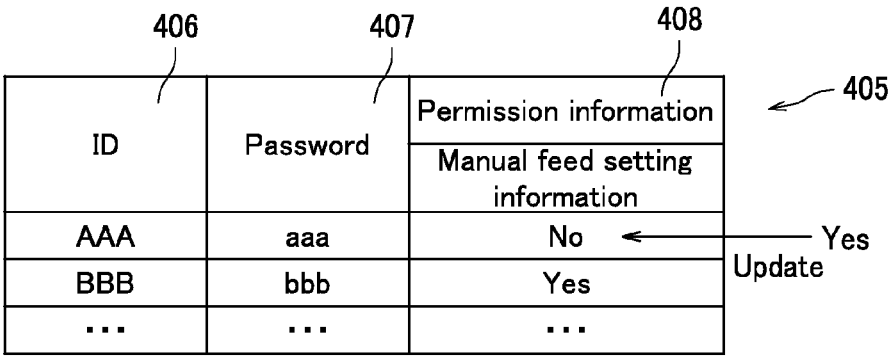
FIG. 5B shows an example of an update to the user authentication table according to the present disclosure.

As shown in FIG. 5A, the error screen 500 displays a message 501, a forced execution key 502, a setting change key 503, and a cancel key 504. The message 501 informs the user that no paper as desired by the user is available. The forced execution key 502 is for causing forced execution of the job using the manual feed tray 104*a* as the substitute paper feed source. The setting change key 503 is for changing the settings as to the specification of the paper size and the paper type.

The user selects the forced execution key 502 on the error screen 500. The forced execution receiving section 207 receives selection of the forced execution key 502 (FIG. 3: S109, YES) and notifies the setting change section 208 about the selection. In response to the notification from the forced execution receiving section 207, the setting change section 208 changes the settings for the job so as to use the manual feed tray 104*a* as the substitute paper feed source (FIG. 3: S110). As a result, in the case where no paper feed source corresponds to (matches) the paper size and the paper type specified in the settings, the user is permitted to set the manual feed tray 104*a* as the substitute paper feed source at a push of the forced execution key 502. Therefore, by subsequently placing paper of the desired size and the desired type on the manual feed tray 104*a*, the user can cause the job to be executed according to the settings on the desired paper.

Upon changing the settings to so as to use the manual feed tray 104*a* as the substitute paper feed source, the setting change section 208 notifies the function control section 203 about the setting change. In response to the notification from the setting change section 208, the function control section 203 executes the job according to the settings (FIG. 3: S105).

In one example, upon changing the settings so as to use the manual feed tray 104*a* as the substitute paper feed source, the setting change section 208 displays a notification screen using the displaying and receiving section 201. The notification screen is to inform the user about the setting change. With the display of the notification screen, the MFP 100 prompts the user to place paper of the desired size and the type on the manual feed tray 104*a*.

In another example, the manual feed tray 104*a* is provided with a detection sensor for detecting the size and the type of paper placed on the manual feed tray 104*a*. In such a case, upon changing the settings so as to use of the manual feed tray 104*a* as the substitute paper feed source, the setting change section 208 notifies the paper feed source selecting section 204 about the setting change. In response to the notification from the setting change section 208, the paper feed source selecting section 204 re-determines whether or not the size and the type of the paper placed on the manual feed tray 104*a* match the size and the type of the paper specified in the settings.

On determining that the size and the type of the paper placed on the manual feed tray 104*a* match the size and the type of the paper specified in the settings, the paper feed source selecting section 204 notifies the function control section 203 about the determination result. In response, the function control section 203 executes the job according to the settings (FIG. 3: S105).

On determining that the size and the type of the paper placed on the manual feed tray 104*a* do not match the size and the type of the paper specified in the settings, the paper feed source selecting section 204 displays a notification screen using the displaying and receiving section 201. The notification screen informs the user that the size and the type of the paper placed on the manual feed tray 104*a* do not match the size and the type of the paper specified in the setting. With the display of the notification screen, the MFP 100 prompts the user as to whether or not to continue the forced execution of the job.

With reference back to S109, the user selects the setting change key 503 on the error screen 500. The forced execution receiving section 207 receives the selection of the setting change key 503 by the user (FIG. 3: S109, NO) and notifies the displaying and receiving section 201 about the selection. In response to the notification from the forced execution receiving section 207, the displaying and receiving section 201 displays a setting change screen on the touch panel. The setting change screen displays a listing of the plurality of paper feed sources each in association with the size and the type of paper currently loaded in the paper feed source, along with a change key for changing the size and the type of paper specified for the job. Then, the displaying and receiving section 201 receives from the user an input instructing to change the settings as to the specification of the paper size and the paper type (FIG. 3: S111). Through the above, the user can cause the execution of the job according to the settings on paper of the desired size and type.

In one example, the displaying and receiving section 201 notifies the function control section 203 about the new specification of the paper size and the paper type as received. The function control section 203 executes the job on paper of the newly designated paper size and type according to the settings (FIG. 3: S105).

When the second determination in S107 results in that the permission information indicates "YES", that is, when the acquired permission information permits use of the manual feed tray 104*a* as the substitute paper feed source (FIG.: S107, YES), the setting change determination section 206 notifies the setting change section 208 that use of the manual feed tray 104*a* as the substitute paper feed source is permitted. In response to the notification from the setting change determination section 206, the setting change section 208 automatically changes the settings for the job so as to use the manual feed tray 104*a* as the substitute paper feed source (FIG. 3: S110) in a manner similar to that described above. In other words, temporality changing the paper feed source to be used for the jog to the manual feed tray 104*a* is permitted according to the permission information associated with the ID of the user. Consequently, when no paper feed source matches the size and the type of paper specified in the settings, the settings are automatically changed so as to use the manual feed tray 104*a* as the substitute paper feed source. This saves the user trouble of having to operate keys.

Upon completion of the job in S105, the function control section 203 notifies the forced execution determination section 209 about the job completion. In response to the notification from the function control section 203, the forced execution determination section 209 determines whether or not an execution number has exceeded a predetermined threshold (2 times) (FIG. 3: S112). Hereinafter, this determination may be referred to as the third determination. The execution number indicates how many times a job is executed in response to selection of the forced execution key 502.

No particular limitations are placed on the method used by the forced execution determination section 209 for determining whether or not the execution number has exceeded the threshold. In one example, upon completion of a job, the forced execution determination section 209 checks using the forced execution receiving section 207 whether or not the job was executed in response to selection of the forced execution key 502. On determining that the job was executed in response to selection of the forced execution key 502, the forced execution determination section 209 increments a predetermined counter by one and determines whether or not the number held in the counter after the increment has exceeded the threshold.

When the third determination in S112 results in that the execution number has not exceeded the threshold (FIG. 3: S112, NO), the forced execution determination section 209 ends the processing without any specific operation. This example applies to the case where a specific user causes forced execution of a job by selecting the forced execution key 502 only infrequently.

When the third determination in S112 results in that the execution number (three times, for example) has exceeded the threshold (FIG. 3: S112, YES), the forced execution determination section 209 notifies the permission information updating section 210 about the determination result. In response to the notification from the forced execution determination section 209, the permission information updating section 210 updates the permission information associated with the user so as to permit use of the manual feed tray 104*a* as the substitute paper feed source (FIG. 3: S113).

No particular limitations are placed on the method used by the permission information updating section 210 for updating the permission information. For example, the MFP 100 may store the user authentication table 405 in a predetermined memory. In such a case, the permission information updating section 210 updates the user authentication table 405 with respect to a piece of permission information 408 associated with the user having the ID 406 currently permitted to use the MFP 100, so as to change the manual feed setting information indicating "NO" to "YES".

Alternatively, the user authentication table 405 may be stored on the server 108. In such a case, the permission information updating section 210 access the server 108 and updates the user authentication table 405 with respect to a piece of permission information 408 associated with the user having the ID 406 currently permitted to use the MFP 100, so as to change the manual feed setting information indicating "NO" to "YES". In the manner described above, when a user frequently executes a job by selecting the forced execution key 502, the permission information 408 is automatically updated. That is, the permission information 408 is rewritten while the user is unaware of the rewriting. This saves the user trouble of having to select the forced execution key 502.

In the above description, the permission information updating section 210 automatically updates the permission information associated with the user, which however should not be construed as limiting. For example, despite that the user needs to repeatedly select the forced execution key 502, the user may possibly prefer not to update the permission information for some reason relevant to ease of use. In view of the possibility, the MFP 100 allows the user to make a setting to prohibit automatic update of permission information. When update of the permission information is prohibited, the permission information updating section 210 does not update the permission information of the user even if the process of updating the permission information of the user is performed. As a result, the permission information is prevented from automatically changed in response to key operations having been made by the user. Update of the permission information is prohibited by appending prohibition information prohibiting update to the permission information. Consequently, the permission information updating section 210 automatically updates the permission information of the user on condition that the prohibition information is not appended. When prohibition information is not appended to the permission information associated with the user, the permission information updating section 210 does not update the permission information of the user.

Although the embodiment of the present disclosure provides the MFP 100 that includes the sections described above, this should not be construed as limiting. For example, the present disclosure may provide a recording medium storing one or more programs implementing the sections described above. In this case, the programs are read by the MFP 100, and the MFP 100 functions as the sections described above. In such a case, the program per se stored on the recording medium produces the advantageous effects of the present disclosure. Furthermore, the steps executed by the sections of the MFP 100 may be provided as a method stored on a hard disk.

As has been described above, an image forming apparatus and an image forming method according to the present disclosure find use in the field of image forming apparatuses (for example, MFPs and copiers) and are effective in implementation as an image forming apparatus and an image forming method in which a paper feed source is automatically switched upon occurrence of paper selection error.

What is claimed is:

1. An image forming apparatus comprising:

a setting change determination section configured to determine, in absence of a paper feed source matching paper information specified in settings that are input by a user for a job to be executed, whether or not permission information associated with the user permits use of a manual feed tray as a substitute paper feed source;

a forced execution receiving section configured to, when the permission information does not permit use of the manual feed tray as the substitute paper feed source, inform the user about absence of a paper feed source matching the paper information specified in the settings and receive selection of a forced execution key by the user, the forced execution key causing forced execution of the job using the manual feed tray as the substitute paper feed source;

a setting change section configured to change the settings for the job so as to use the manual feed tray as the substitute paper feed source in response to selection of the forced execution key;

a forced execution determination section configured to determine whether or not an execution number exceeds a predetermined threshold upon completion of the job, the execution number indicating how many times a job has been executed in response to selection of the forced execution key; and a permission information updating section configured to, when the execution number exceeds the threshold, update the permission information associated with the user so as to permit use of the manual feed tray as the substitute paper feed source.

2. The image forming apparatus according to claim 1, wherein when the permission information permits use of the manual feed tray as the substitute paper feed source, the setting change section automatically changes the settings for the job so as to use the manual feed tray as the substitute paper feed source.

3. The image forming apparatus according to claim 1, wherein when the permission information associated with the user prohibits update of the permission information, the permission information updating section does not update the permission information.

4. The image forming apparatus according to claim 1, further comprising:

a paper feed source selecting section configured to search a plurality of paper feed sources of the image forming apparatus for a paper feed source matching the paper information specified in the settings input for the job; and a memory storing therein information indicating each of the plurality of paper feed sources in association with a size and a type of paper loaded in the paper feed source, wherein the paper feed source selecting section searches for a paper feed source matching a size and a type of paper specified in the settings by checking against the sizes and the types of paper stored in the memory.

5. The image forming apparatus according to claim 1, further comprising:

a paper feed source selecting section configured to search a plurality of paper feed sources of the image forming apparatus for a paper feed source matching the paper information specified in the settings input for the job; and a plurality of sensors disposed for the respective paper feed sources, each of the sensors being configured to detect a size and a type of paper loaded in the corresponding paper feed source, wherein the paper feed source selecting section performs the search for a matching paper feed source based on detection results by the sensors.

6. The image forming apparatus according to claim 1, further comprising a memory that stores therein a user authentication table including the permission information associated with the user; and a permission information acquiring section configured to acquire the permission information associated with the user from the user authentication table.

7. The image forming apparatus according to claim 1, wherein when changing the settings so as to use the manual feed tray as the substitute paper feed source, the setting change section informs the user about the change.

8. The image forming apparatus according to claim 4, further comprising a detection sensor configured to detect a size and a type of paper loaded on the manual feed tray, wherein the paper feed source selecting section determines, when the setting change section changes the settings so as to use the manual feed tray as the substitute paper feed source, whether or not the size and the type of the paper loaded on the manual feed tray, as detected by the detection sensor, match the size and the type of paper specified in the settings, and informs the user about the determination when the determination results in a mismatch.

9. The image forming apparatus according to claim 1, further comprising a displaying and receiving section and a function control section, wherein the forced execution receiving section receives selection of a setting change key, the displaying and receiving section, in response to selection of the setting change key, displays a listing of a plurality of paper feed sources of the image forming apparatus each in association with a size and a type of paper loaded in the paper feed source, along with a change key for changing the size and the type of paper specified for the job, and receives from the user an instruction to change the size and the type of paper to be used in the job, and the function control section executes the job according to the settings that includes paper information specifying the size and the type of paper received by the displaying and receiving section.

10. An image forming method comprising the steps of:

determining, in absence of a paper feed source matching paper information specified in settings that are input by a user for a job to be executed, whether or not permission information associated with the user permits use of a manual feed tray as a substitute paper feed source;

informing the user, when the permission information does not permit use of the manual feed tray as the substitute paper feed source, about absence of a paper feed source matching the paper information specified in the settings and receiving selection of a forced execution key by the user, the forced execution key causing forced execution of the job using the manual feed tray as the substitute paper feed source;

changing the settings for the job so as to use the manual feed tray as the substitute paper feed source in response to selection of the forced execution key;

determining whether or not an execution number exceeds a predetermined threshold upon completion of the job, the execution number indicating how many times a job has been executed in response to selection of the forced execution key; and updating, when the execution number exceeds the threshold, the permission information associated with the user so as to permit use of the manual feed tray as the substitute paper feed source.

* * * * *